US009011563B2

(12) United States Patent
Sung

(10) Patent No.: US 9,011,563 B2
(45) Date of Patent: Apr. 21, 2015

(54) METHODS FOR ORIENTING SUPERABRASIVE PARTICLES ON A SURFACE AND ASSOCIATED TOOLS

(76) Inventor: Chien-Min Sung, Tansui (TW)

( * ) Notice: Subject to any disclaimer, the term of this patent is extended or adjusted under 35 U.S.C. 154(b) by 365 days.

(21) Appl. No.: 12/328,338

(22) Filed: Dec. 4, 2008

(65) Prior Publication Data

US 2009/0145045 A1 Jun. 11, 2009

Related U.S. Application Data

(60) Provisional application No. 60/992,966, filed on Dec. 6, 2007.

(51) Int. Cl.

| | |
|---|---|
| ***B24D 3/02*** | (2006.01) |
| ***C09C 1/68*** | (2006.01) |
| ***C09K 3/14*** | (2006.01) |
| ***B24D 3/06*** | (2006.01) |
| ***B24B 53/017*** | (2012.01) |
| ***B24D 18/00*** | (2006.01) |

(52) U.S. Cl.

CPC ..... *B24D 3/06* (2013.01); *B24B 53/017* (2013.01); *B24D 18/0009* (2013.01)

(58) Field of Classification Search

USPC ..... 51/293, 307

See application file for complete search history.

(56) References Cited

U.S. PATENT DOCUMENTS

| | | | | |
|---|---|---|---|---|
| 187,593 A | | 2/1877 | Brown et al. | |
| 1,854,071 A | * | 4/1932 | Schacht | 51/295 |
| 1,988,065 A | | 1/1935 | Wooddell | |
| 2,027,087 A | * | 1/1936 | Buckner | 51/295 |
| 2,027,307 A | * | 1/1936 | Schacht | 51/295 |
| 2,033,991 A | * | 3/1936 | Melton et al. | 118/623 |
| 2,035,521 A | * | 3/1936 | Benner et al. | 51/293 |
| RE20,660 E | * | 2/1938 | Schacht | 51/295 |
| 2,184,348 A | * | 12/1939 | Kirchner et al. | 51/293 |
| 2,187,624 A | * | 1/1940 | Melton et al. | 118/638 |
| 2,194,253 A | * | 3/1940 | Benner et al. | 118/638 |
| 2,268,663 A | | 1/1942 | Kuzmick | |
| 2,281,558 A | * | 5/1942 | Cross | 51/295 |
| 2,307,461 A | | 1/1943 | Ogden | |
| 2,318,570 A | * | 5/1943 | Carlton | 427/474 |
| 2,334,572 A | * | 11/1943 | Melton et al. | 51/293 |
| 2,612,348 A | | 9/1952 | Catallo | |
| 2,725,693 A | | 12/1955 | Smith | |

(Continued)

FOREIGN PATENT DOCUMENTS

| | | |
|---|---|---|
| CN | 1494984 | 5/2004 |
| EP | 0238434 | 3/1987 |

(Continued)

OTHER PUBLICATIONS

Syndite, elementsix advancing diamond, 2 pages. www.e6.com.

(Continued)

*Primary Examiner* — Kaj K Olsen
*Assistant Examiner* — Ross J Christie
(74) *Attorney, Agent, or Firm* — Thorpe North & Western, LLP

(57) ABSTRACT

Methods of making a superabrasive tool precursor are disclosed, along with such precursors and associated tools. Particularly, methods are disclosed for orienting superabrasive particles in a viscous binding material in order to provide tools based thereupon and having desired performance characteristics.

12 Claims, 4 Drawing Sheets

(56) References Cited

U.S. PATENT DOCUMENTS 2,811,960 A 11/1957 Fessel
2,867,086 A 1/1959 Haley
2,876,086 A 3/1959 Raymond
2,947,608 A 8/1960 Hall
2,652,951 A 9/1960 Simpson
2,952,951 A 9/1960 Simpson
3,067,551 A 12/1962 Maginnis
3,121,981 A 2/1964 Hurst
3,127,715 A 4/1964 Christensen
3,146,560 A 9/1964 Hurst
3,276,852 A 10/1966 Lemelson
3,293,012 A 12/1966 Smiley
3,372,010 A 3/1968 Parsons
3,377,411 A * 4/1968 Charvat ..... 51/298
3,416,560 A 12/1968 Bruno
3,440,774 A * 4/1969 Curn ..... 51/309
3,608,134 A * 9/1971 Cook ..... 425/117
3,625,666 A * 12/1971 James ..... 51/295
3,630,699 A 12/1971 Catlin
3,631,638 A 1/1972 Yoshikawa et al.
3,706,650 A 12/1972 Eisner
2,078,354 A 4/1973 Webster
3,743,489 A 7/1973 Wentorf et al.
3,767,371 A 10/1973 Wentorf et al.
3,802,130 A 4/1974 Lindenbeck
3,819,814 A 6/1974 Pope
3,852,078 A 12/1974 Wakatsuki
3,894,673 A 7/1975 Lowder et al.
3,982,358 A 9/1976 Fukuda
4,018,576 A 4/1977 Lowder et al.
4,037,367 A 7/1977 Kruse
4,078,906 A 3/1978 Green
4,149,881 A 4/1979 D'Silva
4,151,154 A 4/1979 Berger
4,155,721 A 5/1979 Fletcher
4,182,628 A 1/1980 D'Silva
4,188,194 A 2/1980 Gorrigan
4,201,601 A 5/1980 D'Silva
4,211,294 A 7/1980 Multakh
4,211,924 A 7/1980 Muller et al.
4,224,380 A 9/1980 Bovenkerek et al.
4,228,214 A 10/1980 Steigelman et al.
4,229,186 A 10/1980 Wilson
4,273,561 A 6/1981 Villalobos
4,287,168 A 9/1981 Wentorf et al.
4,289,503 A 9/1981 Corrigan
4,341,532 A 7/1982 Oide
4,355,489 A 10/1982 Heyer et al.
4,481,016 A 11/1984 Campbell et al.
4,525,179 A 6/1985 Gigl
4,547,257 A 10/1985 Iizuka et al.
4,551,195 A 11/1985 Iizuka et al.
4,565,034 A 1/1986 Sekiya
4,610,699 A 9/1986 Yazu et al.
4,617,181 A 10/1986 Yazu et al.
4,629,373 A 12/1986 Hall
4,632,817 A 12/1986 Yazu et al.
4,662,896 A 5/1987 Dennis
4,669,522 A 6/1987 Griffin
4,680,199 A 7/1987 Vontell et al.
4,712,552 A 12/1987 Pangburn
4,737,162 A 4/1988 Grazen
4,749,514 A 6/1988 Murakami et al.
4,770,907 A 9/1988 Kimura
4,776,861 A 10/1988 Frushour
4,780,274 A 10/1988 Barr
4,797,241 A 1/1989 Peterson et al.
4,828,582 A 5/1989 Frushour
4,849,602 A 7/1989 Gardner
4,863,573 A 9/1989 Moore et al.
4,883,500 A 11/1989 Deakins et al.
4,908,046 A 3/1990 Wiand
4,916,869 A 4/1990 Oliver
4,923,490 A 5/1990 Johnson et al.
4,925,457 A 5/1990 deKok et al.
4,927,619 A 5/1990 Tsuji
4,943,488 A 7/1990 Sung et al.
4,945,686 A 8/1990 Wiand
4,949,511 A 8/1990 Endo et al.
4,954,139 A 9/1990 Cerutti
4,968,326 A 11/1990 Wiand
5,000,273 A 3/1991 Horton et al.
5,011,513 A * 4/1991 Zador et al. ..... 51/293
5,022,895 A 6/1991 Wiand
5,024,680 A 6/1991 Chen et al.
5,030,276 A 7/1991 Sung et al.
5,037,451 A 8/1991 Burnand et al.
5,043,120 A 8/1991 Corrigan
5,049,165 A 9/1991 Tselesin
5,092,082 A 3/1992 Padberg
5,092,910 A 3/1992 deKok et al.
5,131,924 A 7/1992 Wiand
5,133,782 A 7/1992 Wiand
5,137,543 A 8/1992 Heath et al.
5,151,107 A 9/1992 Cho et al.
5,164,247 A 11/1992 Solanki et al.
5,176,155 A 1/1993 Rudolph, Jr.
5,190,568 A 3/1993 Tselesin
5,194,070 A 3/1993 Sumiya et al.
5,194,071 A 3/1993 Corrigan et al.
5,195,403 A 3/1993 Sani et al.
5,195,404 A 3/1993 Notter et al.
5,197,249 A 3/1993 Wiand
5,203,881 A 4/1993 Wiand
5,232,320 A 8/1993 Tank et al.
5,243,790 A 9/1993 Gagne
5,246,884 A 9/1993 Jaso
5,247,765 A 9/1993 Quintana
5,248,317 A 9/1993 Tank
5,264,011 A 11/1993 Brown et al.
5,266,236 A 11/1993 Bovenkerk
5,271,547 A 12/1993 Carlson
5,273,730 A 12/1993 Yoshida et al.
5,295,402 A 3/1994 Bovenkerk
5,314,513 A 5/1994 Miller
5,328,548 A 7/1994 Tsuji et al.
5,364,423 A 11/1994 Bigelow et al.
5,374,293 A 12/1994 Takashita et al.
5,380,390 A * 1/1995 Tselesin ..... 156/230
5,443,032 A 8/1995 Vichr et al.
5,453,106 A * 9/1995 Roberts ..... 51/307
5,454,343 A 10/1995 Eun et al.
5,458,754 A 10/1995 Sathrum et al.
5,486,131 A 1/1996 Cesna et al.
5,492,771 A 2/1996 Lowder et al.
5,496,386 A 3/1996 Broberg et al.
5,500,248 A 3/1996 Iacovangelo et al.
5,505,272 A 4/1996 Clark
5,518,443 A 5/1996 Fisher
5,527,424 A 6/1996 Mullins
5,536,202 A 7/1996 Appel et al.
5,547,417 A 8/1996 Breivogel et al.
5,551,959 A 9/1996 Martin et al.
5,560,745 A 10/1996 Roberts
5,560,754 A 10/1996 Johnson et al.
5,609,286 A 3/1997 Anthon
5,620,489 A 4/1997 Tselesin
5,660,894 A 8/1997 Chen et al.
5,669,943 A 9/1997 Horton et al.
5,674,572 A 10/1997 Sarin et al.
5,725,421 A 3/1998 Goers et al.
5,746,931 A 5/1998 Graebner
RE35,812 E 6/1998 Oliver
5,772,756 A 6/1998 Davies et al.
5,776,214 A 7/1998 Wood
5,779,743 A 7/1998 Wood
5,791,975 A 8/1998 Cesna et al.
5,801,073 A 9/1998 Robbins et al.
5,816,891 A 10/1998 Woo
5,820,450 A 10/1998 Calhoun
5,833,519 A 11/1998 Moore
5,851,138 A 12/1998 Hempel
5,855,314 A 1/1999 Shiue et al.
5,868,806 A 2/1999 Nishio et al.

(56) References Cited

U.S. PATENT DOCUMENTS 5,885,137 A 3/1999 Ploessl
5,902,173 A 5/1999 Tanaka
5,916,011 A 6/1999 Kim
5,919,084 A 7/1999 Powell et al.
5,921,856 A 7/1999 Zimmer
5,924,917 A * 7/1999 Benedict et al. ..... 451/526
5,961,373 A 10/1999 Lai
5,975,988 A 11/1999 Christianson
5,976,001 A 11/1999 Powell et al.
5,976,205 A 11/1999 Andrews et al.
5,980,852 A 11/1999 Gurns et al.
5,980,982 A 11/1999 Degawa et al.
5,985,228 A 11/1999 Corrigan et al.
6,001,008 A 12/1999 Fujimori et al.
6,001,174 A 12/1999 Fang
6,024,824 A * 2/2000 Krech ..... 156/279
6,027,659 A 2/2000 Billet
6,030,595 A 2/2000 Sumiya et al.
6,039,641 A 3/2000 Sung
6,054,183 A 4/2000 Zimmer et al.
6,093,280 A 7/2000 Kirchner et al.
6,106,382 A 8/2000 Sakaguchi
6,123,612 A 9/2000 Goers
6,159,087 A 12/2000 Birang et al.
6,159,286 A 12/2000 Sung
6,179,886 B1 1/2001 Gordeev et al.
6,190,240 B1 2/2001 Kinoshita et al.
6,196,911 B1 3/2001 Preston et al.
6,200,360 B1 3/2001 Imai et al.
6,206,942 B1 3/2001 Wood et al.
6,213,856 B1 4/2001 Cho et al.
6,217,413 B1 4/2001 Christianson
6,224,469 B1 5/2001 Ohmori et al.
6,258,138 B1 * 7/2001 DeVoe et al. ..... 51/307
6,258,201 B1 * 7/2001 Krech ..... 156/279
6,258,237 B1 7/2001 Gal-Or et al.
6,281,129 B1 8/2001 Easter et al.
6,284,556 B1 9/2001 Wang et al.
6,286,498 B1 9/2001 Sung
6,293,854 B1 9/2001 Kimura et al.
6,299,508 B1 10/2001 Gagliardi et al.
6,312,324 B1 11/2001 Mitsui et al.
6,319,108 B1 11/2001 Adefris et al.
6,325,709 B1 12/2001 Nanda et al.
6,346,202 B1 2/2002 Molnar
6,354,918 B1 3/2002 Togawa et al.
6,354,929 B1 3/2002 Adefris et al.
6,368,198 B1 4/2002 Sung et al.
6,371,838 B1 4/2002 Holzapfel
6,371,842 B1 4/2002 Romero
6,409,580 B1 6/2002 Lougher et al.
6,416,878 B2 7/2002 An
6,439,986 B1 8/2002 Myoung et al.
6,446,740 B2 9/2002 Eyre
6,458,018 B1 10/2002 Goers et al.
6,478,831 B2 11/2002 Tselesin
6,497,853 B1 12/2002 Davies et al.
6,544,599 B1 4/2003 Brown et al.
6,551,176 B1 4/2003 Garretson
6,605,798 B1 8/2003 Cullen
6,607,423 B1 8/2003 Areayan et al.
6,616,725 B2 9/2003 Cho et al.
6,626,167 B2 9/2003 Kim et al.
6,627,168 B1 9/2003 Ohtsubo et al.
6,629,884 B1 10/2003 Goers
6,672,943 B2 1/2004 Vogtmann et al.
6,679,243 B2 1/2004 Sung
6,692,547 B2 2/2004 Kim
6,694,847 B2 2/2004 Hiroyasu et al.
6,722,952 B2 4/2004 Goers et al.
6,749,485 B1 6/2004 James et al.
6,755,720 B1 6/2004 Ishizaki et al.
6,769,969 B1 8/2004 Duescher
6,818,029 B2 11/2004 Myoung et al.
6,824,455 B2 11/2004 Osterheld et al.
6,835,365 B1 12/2004 Davies et al.
6,837,979 B2 1/2005 Uzho et al.
6,884,155 B2 4/2005 Sung et al.
6,899,592 B1 5/2005 Kojima et al.
6,905,571 B2 6/2005 Sakuma et al.
6,945,857 B1 9/2005 Doan et al.
6,979,357 B2 12/2005 Fries et al.
7,021,995 B2 4/2006 Toge et al.
7,033,408 B2 4/2006 Fries et al.
7,044,990 B2 * 5/2006 Ishizaki et al. ..... 51/295
7,066,795 B2 6/2006 Balagani et al.
7,124,753 B2 10/2006 Sung
7,150,677 B2 12/2006 Yamashita et al.
7,198,553 B2 4/2007 Goers
7,201,645 B2 4/2007 Sung
7,247,577 B2 7/2007 Palmgren et al.
7,258,708 B2 8/2007 Sung
7,261,621 B2 8/2007 Moon et al.
7,323,049 B2 1/2008 Sung
7,368,013 B2 5/2008 Sung
7,384,436 B2 6/2008 Sung
7,404,857 B2 7/2008 Sung
7,465,217 B2 12/2008 Kinoshita et al.
7,494,404 B2 2/2009 Sung
7,585,366 B2 9/2009 Sung
7,641,538 B2 1/2010 Goers
7,651,368 B2 1/2010 Kendall et al.
7,658,666 B2 2/2010 Sung
7,840,305 B2 11/2010 Behr et al.
8,398,466 B2 3/2013 Sung et al.
2001/0003884 A1 6/2001 Wei et al.
2001/0009844 A1 7/2001 Cho et al.
2001/0046835 A1 11/2001 Wielonski et al.
2002/0014041 A1 2/2002 Baldoni et al.
2002/0042200 A1 4/2002 Fawcett
2002/0127962 A1 9/2002 Cho et al.
2002/0139680 A1 10/2002 George
2002/0164928 A1 11/2002 Tolles
2002/0173234 A1 11/2002 Sung et al.
2003/0054746 A1 3/2003 Nussbaumer et al.
2003/0084894 A1 5/2003 Sung
2003/0092357 A1 5/2003 Yoon et al.
2003/0114094 A1 6/2003 Myoung et al.
2003/0207659 A1 11/2003 Annen et al.
2004/0009742 A1 1/2004 Lin et al.
2004/0023610 A1 2/2004 Hu et al.
2004/0060243 A1 4/2004 Fries et al.
2004/0079033 A1 4/2004 Long
2004/0091627 A1 5/2004 Ohara et al.
2004/0107648 A1 6/2004 Sung
2004/0180617 A1 9/2004 Goers
2004/0185763 A1 * 9/2004 Ishizaki et al. ..... 451/541
2004/0203325 A1 10/2004 Donohue
2005/0032462 A1 2/2005 Gagliardi et al.
2005/0032469 A1 2/2005 Duescher
2005/0060941 A1 3/2005 Provow et al.
2005/0095959 A1 5/2005 Sung
2005/0118939 A1 6/2005 Duescher
2005/0215188 A1 9/2005 Toge et al.
2005/0227590 A1 10/2005 Sung
2005/0260939 A1 11/2005 Andrews et al.
2006/0073774 A1 * 4/2006 Sung ..... 451/56
2006/0079160 A1 4/2006 Balagani et al.
2006/0079162 A1 4/2006 Yamashita et al.
2006/0128288 A1 6/2006 An et al.
2006/0135050 A1 6/2006 Petersen et al.
2006/0143991 A1 7/2006 Sung
2006/0254154 A1 11/2006 Huang et al.
2006/0258276 A1 11/2006 Sung
2007/0051354 A1 3/2007 Sung
2007/0051355 A1 3/2007 Sung
2007/0060026 A1 3/2007 Sung
2007/0066194 A1 3/2007 Wielonski et al.
2007/0093181 A1 4/2007 Lugg et al.
2007/0128994 A1 6/2007 Sung
2007/0155298 A1 7/2007 Sung
2007/0249270 A1 10/2007 Sung
2007/0254566 A1 11/2007 Sung
2007/0264918 A1 11/2007 Sung

(56) References Cited

U.S. PATENT DOCUMENTS

| | | | | |
|---|---|---|---|---|
| 2007/0266639 | A1 | 11/2007 | Sung | |
| 2007/0295267 | A1 | 12/2007 | Sung | |
| 2008/0076338 | A1 | 3/2008 | Andrews et al. | |
| 2008/0096479 | A1 | 4/2008 | Sung | |
| 2008/0153398 | A1 | 6/2008 | Sung | |
| 2008/0171503 | A1 | 7/2008 | Sung | |
| 2008/0271384 | A1 | 11/2008 | Puthanangady et al. | |
| 2008/0292869 | A1* | 11/2008 | Sung | 51/297 |
| 2009/0068937 | A1 | 3/2009 | Sung et al. | |
| 2009/0093195 | A1 | 4/2009 | Sung | |
| 2009/0123705 | A1 | 5/2009 | Sung | |
| 2009/0145045 | A1 | 6/2009 | Sung | |
| 2009/0215363 | A1 | 8/2009 | Sung | |
| 2009/0283089 | A1 | 11/2009 | Sung | |
| 2010/0015898 | A1 | 1/2010 | An et al. | |
| 2010/0022174 | A1 | 1/2010 | Chou et al. | |
| 2010/0139174 | A1 | 6/2010 | Sung | |
| 2010/0186479 | A1 | 7/2010 | Borucki et al. | |
| 2010/0203811 | A1 | 8/2010 | Philipossian et al. | |
| 2010/0221988 | A1 | 9/2010 | Sung | |
| 2010/0221990 | A1 | 9/2010 | Sung | |
| 2010/0248595 | A1 | 9/2010 | Dinh-Ngoc | |
| 2010/0248596 | A1 | 9/2010 | Sung | |
| 2010/0261419 | A1 | 10/2010 | Sung | |
| 2011/0212670 | A1 | 9/2011 | Sung | |
| 2011/0275288 | A1 | 11/2011 | Sung | |
| 2011/0296766 | A1 | 12/2011 | Sung | |
| 2012/0241943 | A1 | 9/2012 | Sung | |

FOREIGN PATENT DOCUMENTS

| | | |
|---|---|---|
| EP | 1 075 898 | 2/2001 |
| EP | 1075898 | 2/2001 |
| GB | 2239011 | 6/1991 |
| GB | 2366804 | 3/2002 |
| JP | 2003/071718 | 3/2003 |
| KR | 10/2002/0036138 | 5/2002 |
| KR | 10/2007/0063569 | 6/2007 |
| WO | WO 2004/094106 | 11/2004 |
| WO | WO 2006/039413 | 4/2006 |
| WO | WO 2006/124792 | 11/2006 |

OTHER PUBLICATIONS

U.S. Appl. No. 12/255,823, filed Oct. 22, 2008; Chien-Min Sung; notice of allowance dated Dec. 26, 2012.
U.S. Appl. No. 12/267,172, filed Nov. 7, 2008; Chien-Min Sung; notice of allowance dated Oct. 22, 2012.
U.S. Appl. No. 12/168,110, filed Jul. 5, 2008; Chien-Min Sung; notice of allowance dated Jan. 18, 2013.
U.S. Appl. No. 12/255,823, filed Oct. 22, 2005; Chien-Min Sung; office action issued Mar. 7, 2012.
U.S. Appl. No. 12/168,110, filed Jul. 5, 2008; Chien-Min Sung; office action issued May 14, 2012.
U.S. Appl. No. 12/715,583, filed Mar. 2, 2010; Chien-Min Sung; office action issued Mar. 21, 2012.
U.S. Appl. No. 11/805,549, filed May 22, 2007, Chien-Min Sung, Office Action issued Oct. 6, 2010.
U.S. Appl. No. 12/267,172, filed Nov. 7, 2008; Chien-Min Sung; office action dated Jul. 9, 2012.
U.S. Appl. No. 12/255,823, filed Oct. 22, 2008; Chien-Min Sung; notice of allowance dated Sep. 21, 2012.
U.S. Appl. No. 12/168,110, filed Jul. 5, 2008; Chien-Min Sung; notice of allowance dated Sep. 28, 2012.
U.S. Appl. No. 12/267,172, filed Nov. 7, 2008 Chien-Min Sung; office action issued Jan. 3, 2012.
PCT/US2013/042538; filed May 23, 2013; Chien-Min Sung; International Search Report dated Aug. 27, 2013.
U.S. Appl. No. 13/239,198, filed Sep. 21, 2011; Chien-Min Sung; office action dated Jul. 23, 2013.
U.S. Appl. No. 13/113,779, filed May 23, 2011; Chien-Min Sung; office action dated Nov. 12, 2013.
U.S. Appl. No. 13/153,176, filed Jun. 3, 2011; Chien-Min Sung; office action dated Dec. 6, 2013.
U.S. Appl. No. 13/239,198, filed Sep. 21, 2011; Chien-Min Sung; Notice of Allowance mailed Mar. 4, 2014.
U.S. Appl. No. 13/794,164, filed Mar. 11, 2013; Chien-Min Sung; office action dated Jul. 16, 2014.
Colmonoy Technical Data Sheet; No. DSP-A; 1993.
Endecott's Specifications; 2004.
Kennametal Specification for DMHPM002 Hot Press Matrix N-50 Dec. 6, 2001.
Material Safety Data Sheet (MSDS), Wall Colmonoy Corporation; prepared Jul. 20, 1989.
Material Safety Data Sheet MSDS); Kennametal; issued Jun. 11, 2004.
Sung et al.; The Eastern Wind of Diamond Symthesis; New Diamond and Frontier Carpon Technology; 2003; pp. 47-61; vol. 13, No. 1.
Sung et al; Mechanism of the Solvent-Assisted Graphite to Diamond Transition Under High Pressure: Implications for the Selection of Catalysts, High Temperatures—High Pressure; 1995/1996; pp. 523-546; vol. 27/28.
Syndite, CTM302; Announcement, Elementsix Advancing Diamond; Jan. 14, 2003; http://www.e6.com/en/resourches/announcementsheets/CTM302.pdf; as accessed on Dec. 16, 2008.
Yasunaga et al; Advances in Abrasive Technology, III; Soc. Of Grinding Engineers (SGE) in Japan; 2000.
U.S. Appl. No. 13/021,350, filed Feb. 4, 2011; Chien-Min Sung; office action issued Feb. 7, 2012.
U.S. Appl. No. 13/021,350, filed Feb. 4, 2011; Chien-Min Sung; office action issued Aug. 10, 2012.
U.S. Appl. No. 13/021,350, filed Feb. 4, 2011; Chien-Min Sung; office action issued Aug. 31, 2011.
U.S. Appl. No. 13/021,350, filed Feb. 4, 2011; Chien-Min Sung; office action dated Mar. 20, 2013.
U.S. Appl. No. 12/715,583, filed Mar. 2, 2010; Chien-Min Sung; office action issued Aug. 9, 2012.
U.S. Appl. No. 12/715,583, filed Mar. 2, 2010; Chien-Min Sung; office action issued Oct. 25, 2011.
U.S. Appl. No. 13/362,917, filed Jan. 31, 2012; Chien-Min Sung; office action issued Jun. 14, 2012.
U.S. Appl. No. 13/362,917, filed Jan. 13, 2012; Chien-Min Sung; office action dated Dec. 31, 2012.
U.S. Appl. No. 13/362,917, filed Jan. 31, 2012; Chien-Min Sung; office action dated Apr. 10, 2013.
U.S. Appl. No. 12/168,110, filed Jul. 5, 2008; Chien-Min Sung; Notice of Allowance issued Sep. 28, 2012.
U.S. Appl. No. 12/255,823, filed Oct. 22, 2008; Chien-Min Sung; Notice of Allowance issued Sep. 21, 2012.
U.S. Appl. No. 12/715,583, filed Mar. 2, 2010; Chien Min Sung; Notice of Allowance dated Dec. 7, 2012.
U.S. Appl. No. 12/267,172, filed Nov. 7, 2008; Chien-Min Sung; notice of allowance dated Jan. 7, 2013.
U.S. Appl. No. 13/239,189, filed Sep. 21, 2011; Chien-Min Sung; notice of allowance dated May 3, 2013.
PCT Application PCT.US2011/052627; filed Sep. 21, 2011; Chien-Min Sung; International Search Report mailed May 11, 2012.
PCT Application PCT/US2007/024165; filed Nov. 16, 2007; Chien-Min Sung; International Search Report mailed May 23, 2011.
PCT Application PCT/US2012/039199; filed May 23, 2012; Chien-Min Sung; International Search Report dated Dec. 18, 2012.
U.S. Appl. No. 08/832,852, filed Apr. 4, 1997; Chien-Min Sung.
U.S. Appl. No. 09/447,620, filed Nov. 22, 1999; Chien-Min Sung.
U.S. Appl. No. 11/512/755, filed Aug. 29, 2006; Chien-Min Sung.
U.S. Appl. No. 13/021,350, filed Feb. 4, 2011; Chien-Min Sung.
U.S. Appl. No. 12/726,786, filed Mar. 18, 2010; Chien-Min Sung; office action dated Mar. 19, 2013.
U.S. Appl. No. 12/726,786, filed Mar. 18, 2010; Chien-Min Sung; notice of allowance dated Sep. 4, 2013.

* cited by examiner

METHODS FOR ORIENTING SUPERABRASIVE PARTICLES ON A SURFACE AND ASSOCIATED TOOLS

PRIORITY DATA

This application claims the benefit of U.S. Provisional Patent Application Ser. No. 60/992,966, filed on Dec. 6, 2007, which is incorporated herein by reference.

FIELD OF THE INVENTION

The present invention relates generally to superabrasive tools and methods for making such tools. Accordingly, the present invention involves the chemical and material science fields.

BACKGROUND

A wide variety of applications rely on tools based on superabrasive cutting elements. These applications range from sawing and drilling through hard materials such as stone, masonry, concrete, and metal, to conditioning the pads used in chemical mechanical polishing (CMP) of silicon wafers for semiconductors. Each application requires different types of superabrasive tools and places different demands upon those tools. In order to better match tool performance with the demands of each application, tool manufacturing processes would benefit from methods that allow more effective control over the characteristics of each tool.

SUMMARY

The present invention provides methods of making an abrasive tool precursor. In one aspect, such a method may include the steps of placing a layer of a binding material on a surface of a substrate, distributing abrasive particles on the layer of binding material, and then allowing the abrasive particles to pass at least partially through the binding material and toward the substrate while rotating until at least a number of the abrasive particles exhibit substantially the same orientation.

A more particular embodiment provides a method of making a superabrasive tool precursor, comprising the steps of placing a layer of a viscous medium on a surface of a substrate, distributing superabrasive particles on the layer of viscous medium, and then heating the viscous medium to decrease its viscosity. The superabrasive particles then move at least partially through the viscous medium toward the substrate, being free to rotate while so moving, so that a percentage of the superabrasive particles exhibit substantially the same orientation when they come to rest. The movement of the particles may be induced by gravity or by other imposed forces such as centripetal force. In some embodiments of the present invention, other mechanisms for reducing the viscosity of the medium can be used, such as solvents or other agents/mechanisms. In yet further embodiments of the present invention, the viscosity of the material may not be reduced prior to the application of force on the particles, but rather, the viscosity may be sufficient to prevent substantial movement of the particles through the medium without the use of force, while allowing movement upon the application of force, such as those forces discussed herein.

The present invention also provides a method of making a superabrasive tool, comprising the steps of placing a layer of a binding material on an upper surface of a substrate; distributing superabrasive particles on the layer of binding material; inducing the superabrasive particles to pass at least partially through the binding material and toward the substrate while rotating until at least a number of the superabrasive particles exhibit substantially the same orientation; attaching a tool body to the portion of the superabrasive particles facing away from the substrate; and removing the substrate and the layer of binding material so as to expose the portion of the superabrasive particles that faced the substrate.

Also provided is a superabrasive tool precursor, comprising a substrate, a layer of binding material on a surface of the substrate, and a plurality of superabrasive particles distributed in the binding material. The binding material exhibits a viscosity such that the superabrasive particles are free to move through the binding material toward the substrate and to rotate in the binding material in response to an external force applied to them.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

Figure 1:
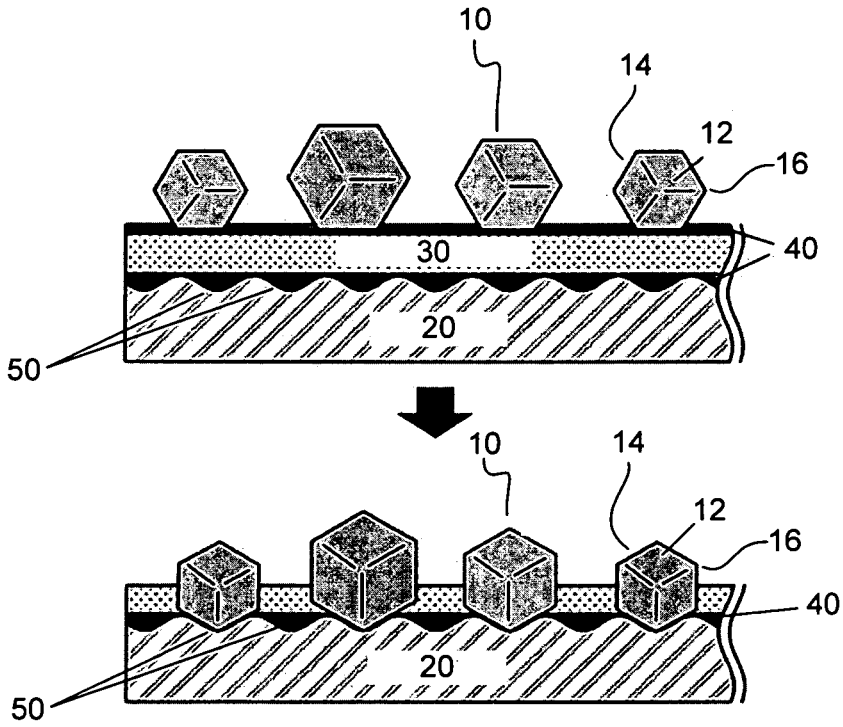
FIG. 1 is a side view of a superabrasive tool precursor in accordance with an embodiment of the present invention.

Reference will now be made to the exemplary embodiments illustrated, and specific language will be used herein to describe the same. It will nevertheless be understood that no limitation of the scope of the invention is thereby intended.

DETAILED DESCRIPTION OF EXAMPLE EMBODIMENTS

Before the methods and articles of the present invention are disclosed and described, it is to be understood that this invention is not limited to the particular process steps and materials disclosed herein, but is extended to equivalents thereof as would be recognized by those ordinarily skilled in the relevant arts. It should also be understood that terminology employed herein is used for the purpose of describing particular embodiments only and is not intended to be limiting.

It must be noted that, as used in this specification and the appended claims, the singular forms "a," and, "the" include plural referents unless the context clearly dictates otherwise. Thus, for example, reference to a "superabrasive particle" includes reference to one or more of such superabrasive particles.

DEFINITIONS

In describing and claiming the present invention, the following terminology will be used in accordance with the definitions set forth below.

As used herein, "superabrasive particle" and "superabrasive crystal" or similar phrases may be used interchangeably, and refer to any natural or synthetic super hard crystalline, or polycrystalline substance, or mixture of substances and include but are not limited to diamond, polycrystalline diamond (PCD), cubic boron nitride (cBN), and polycrystalline cubic boron nitride (PcBN).

As used herein, "superhard" and "superabrasive" may be used interchangeably, and refer to a crystalline, or polycrystalline material, or mixture of such materials having a Vickers hardness of about 4000 kg/mm$^2$ or greater. Such materials may include without limitation, diamond, and cubic boron nitride (cBN), as well as other materials known to those skilled in the art.

As used herein, "binding material" refers generally to a material capable of maintaining the relative positioning of particles suspended, embedded, or otherwise distributed therein. Such materials may have this capability by virtue of properties such as viscosity, adhesive properties, electrostatic properties, or any combination thereof.

As used herein, "chemical bond" means a covalent bond, such as a carbide, nitride, or boride bond, rather than mechanical or weaker inter-atom attractive forces.

As used herein, "working end" refers to an end of a particle which is oriented towards and makes contact with a workpiece during tool use. Most often the working end of a particle will be distal from a substrate to which the particle is attached.

As used herein, "sharp portion" means any narrow portion to which a particle may come, including but not limited to corners, ridges, edges, obelisks, and other protrusions.

As used herein, "orientation" means the position or arrangement of a particle in relation to a defined surface, such as a substrate to which it is attached.

As used herein, "substrate" means a solid surface in a tool precursor which supports abrasive particles, and on which abrasive particles may be arranged and stabilized in an arrangement. Substrates useful in the present invention may be any shape, thickness, or material, that is capable of supporting abrasive particles in a manner that is sufficient for its intended purpose. In one aspect, a substrate may be configured so as to hold abrasive particles in such a way that the particles may be attached to a tool.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc. This same principle applies to ranges reciting only one numerical value. Furthermore, such an interpretation should apply regardless of the breadth of the range or the characteristics being described.

A method of making a superabrasive tool precursor can comprise placing a layer of a binding material on a surface of a substrate, distributing superabrasive particles on said binding material, and then allowing or inducing the particles to pass at least partially through the material toward the surface. The distribution may be random, or in a particular desired arrangement across the surface, depending on the dressing performance desired. In one embodiment, the substrate may be temporary and serves merely as a platform for this arrangement so that the arrangement may be eventually transferred to the working surface of a tool. In an alternative embodiment, the substrate is permanent and may itself be in the final tool as either part of the intended working surface, or supporting the intended working surface. In a particular embodiment, an adhesive may be overlaid on the binding material before or after the particles are distributed thereupon in order to preserve the particles' arrangement for subsequent steps in the process.

Various types of superabrasive particles may be utilized in various aspects of the present invention. Such superabrasive materials may include without limitation, diamond, polycrystalline diamond (PCD), cubic boron nitride (cBN) and polycrystalline cubic born nitride (PcBN). In some aspects, the superabrasive particles may include diamond. In one aspect, the diamond superabrasive particles may exhibit a combination of cubic and octahedral faces. Further, the superabrasive particles can be of a predetermined shape. For example, the superabrasive particles can be a euhedral shape or either a octahedral or cubo-octahedral shape. Polycrystalline particles may exhibit additional shapes, including cubic, rhomboidal, pyramidal, and decahedral. In addition to superabrasives, the methods of the present invention may be used with other abrasive particles including, without limitation, particles that comprise glass, metal, ceramics, composite materials such as cermets, and minerals having a Vickers hardness of 200 kg/mm$^2$ or higher.

Superabrasive particles attached a tool may exhibit any number of orientations relative to the surface to which they are attached. Particle performance on a workpiece is largely dictated by the working end of the particle. Depending upon the shape of the particle, this working end can be a sharp portion of the particle, or a more planar portion of the particle. This can be illustrated by considering superabrasive particles having a euhedral crystalline shape that includes a plurality of faces, edges, and apexes. Each of these features will perform differently when serving as the working end of the crystal. On such a shape, the apexes, and to a lesser degree the edges, represent the sharp portions of the crystal. These will tend to cut deeper, narrower grooves in the material of a workpiece and therefore work more aggressively, but are also less durable than the face of the crystal. In contrast, a crystal face will tend to cut shallower, broader grooves, but are thought to be more durable than sharp portions and therefore wear more slowly. It can be appreciated, then, that the ability to choose the orientation that superabrasive particles will exhibit in a tool allows one to determine the performance characteristics of the tool. This is particularly possible when a plurality of particles can be made to assume a particular orientation. Accordingly, the present invention provides methods directed to these results.

Once the superabrasive particles are distributed as needed, it is desirable that the they be made to assume a common orientation or a set of orientations. This requires that at least some of the particles change their original orientation by rotating. The present invention provides for such rotation by inducing the particles to enter the binding material, so that the binding material serves as a medium that supports the particles while affording them freedom to rotate. In this sense, it is highly preferable that the binding material have some measurable viscosity so as to provide some measure of buoyancy, though said buoyancy should still be negative. In a particular embodiment, the binding material is a viscous medium. Viscosity serves the purpose of providing support to the particles. However, just as importantly, the viscosity provides for increased drag and frictional forces to be exerted against the planes and angles of the particles as the particles move within the medium. These forces and the shape of the particles interact to produce particle rotation that can be utilized to establish desired particle orientation.

This is exemplified in a particular embodiment of the present invention illustrated in FIG. 1, where superabrasive particles 10 are distributed onto a substantially horizontal substrate 20 covered with a binding material 30. Optionally adhesive 40 may be applied to the substrate and/or binding material to provide stability. The particles are then induced or allowed by gravity to descend into the material. This settling is governed by the principles and forces involved in sedimentation. As each particle settles into the medium, the particle's flat surfaces 12 encounter more drag than the edges 14 or apexes 16. As a consequence, each particle will rotate so as to achieve a lower drag, i.e. it will tend to assume a favored orientation that is dictated by the particle's shape and the forces involved. For many particle shapes, this favored orientation will be with an edge or apex leading the way down through the medium. Eventually each particle will come to rest on the underlying surface, with a substantial number of particles exhibiting a common edge-down or apex-down orientation. In a particular embodiment, the surface may include a plurality of pits 50, where each pit designates the eventual resting place of one or more superabrasive particles. In one aspect, each pit may have been shaped so as to more easily accommodate and stabilize a particle in the favored position.

In order to more effectively control particle placement and orientation, it may be desirable to control the onset of the entry of the particles into the binding material. One way to delay onset until desired is to utilize a binding material that is sufficiently dense that the particles initially float on top of the material once distributed. Therefore in one aspect of the present invention, entry may be initiated by changing the viscosity of the binding material, such as by heating. In a particular aspect, the binding material may be in a solid or semi-solid state when it is laid upon the tool precursor surface and then heated to assume a liquid state after superabrasive particles are applied. Once the density or viscosity of the binding material decreases sufficiently, the superabrasive particles descend into the binding material while rotating in response to forces exerted by the material. For example, where diamond ($\rho$=3.5 gm/cc) is used as the superabrasive, the density of the binding medium should be low enough to allow the diamond to descend—preferably the density is below about 2.0.

Other methods of initiating particle entry into the binding material may involve a more proactive selection of the nature and onset of the force inducing the particles to move toward the tool precursor surface. For example, forces that are similar in nature to gravity can be created by placing the tool precursor elements in a centrifuge. In such an embodiment, particles are induced to enter the medium by the resulting centripetal force acting on them when the centrifuge is activated. In another embodiment, a magnetic or electromagnetic force may be used to move particles made of materials responsive to this force. An added aspect of this approach is that it provides a greater degree of control over many aspects of the process, particularly the magnitude and duration of force to be applied to the particles. By selecting these characteristics, as well as the properties of the binding material and of the superabrasive particles themselves, it is possible to influence the number of particles that will eventually share a given orientation in the finished tool.

It can be appreciated that the magnitude of force will have an effect on the movement of the particles in the binding material. For example, applying greater centripetal force may cause the particles to move more rapidly through the layer of binding material, in turn reducing that amount of time each particle has to change its orientation. However, a more viscous binding material will slow the movement of particles, as well as exerting greater drag forces on them, both promoting more completed rotation and orientation of particles. Other factors that will influence the process are the shape of the particles and the thickness of the binding material layer. One skilled in the art will appreciate that all of these factors can be selected and manipulated to a degree so as to determine the characteristics of the final product. For example, in a particular embodiment the centripetal force is applied until all of the particles come to rest on the substrate. Alternatively, a shorter duration may be chosen in which the particles only pass partially through the binding material. In the present invention, a layer of binding material should be applied to the substrate at a sufficient depth so as to allow the particles to rotate at least somewhat before coming to rest on the substrate. In a particular embodiment, the depth allows the particles to rotate at least 180°.

The combination of force and materials chosen in a given application of the disclosed process to a tool precursor will result in a frequency distribution of orientations among the particles. The fraction of particles occupying an orientation will depend partly on the number and magnitude of forces favoring that orientation and on the opportunity afforded the particle to respond to those forces, with the latter depending on the duration of the forces and the distance traveled. For a given particle shape there may be a number of possible orientations each favored to different degrees by the forces involved. In that case, upon completion of the process the most favored orientations will be most heavily represented with the other possible orientations represented according to what degree each is favored. Accordingly, the factors involved in the process may be manipulated so as to result in nearly all of the superabrasive particles occupying a particular orientation. Alternatively, the process may be directed so that a given frequency distribution of orientations results among the particles. In one aspect the resulting percentage of particles sharing a particular orientation may be from about 50% to about 100%, while in a more particular aspect, the percentage may be from about 65% to about 85%. In either of these aspects, the orientation may be the most favored orientation, e.g. with an apex toward the substrate, or a less favored orientation, e.g. an edge toward the substrate. Furthermore, the remaining particles may share another orientation or may exhibit a frequency distribution of orientations. Because of the different cutting behavior each orientation provides, manipulating the frequency distribution of orientations on a tool allows for subtle manipulation of its overall cutting performance.

Once the placement and orientation of superabrasive particles is complete, the binding material can serve to hold them in place for further processing. For binding materials that are applied in a solid or semi-solid state, the material can simply be allowed to cool and regain its solidity after orientation is complete. Where liquid medium is to be used, it is preferable to use a medium that can be cured to form a solid so as to hold the superabrasive particles in place. Materials that may be used as binding materials in accordance with the present invention include but are not limited to plastics, adhesives, resins, rubbers, and slurries. In a particular embodiment, a plastic is used. In a still more specific embodiment, a thermal plastic is used that changes from substantially solid to liquid upon heating. As mentioned above, the characteristics of the binding material can affect the behavior of particles moving through them. For example, some binding materials may exert less drag on flat portions of particles, making particles less likely to rotate away from a face-down orientation. It may be possible, therefore, to choose a binding material so as to more directly influence the final orientation of particles. One can further use this approach to produce different orientations or distributions of orientations in different subsets of particles in the tool. For example, a given tool precursor of the present invention may include a substrate in which different binding materials are placed in different zones of the surface, so that the resulting tool will present on its working surface a plurality of zones each having differently oriented particles.

A superabrasive tool precursor of the present invention will comprise a substrate overlaid by a layer of binding material with a plurality of superabrasive particles suspended therein. The binding material allows for the particles to rotate in response to sedimentation forces and external forces and thereby assume certain orientations. As stated above, one purpose of this precursor is to facilitate the transfer of the arrangement of superabrasive particle to a tool, while preserving the spatial arrangement and orientations of the particles attained on the precursor. Accordingly, a method of making a superabrasive tool can comprise the use of a tool precursor according to the present invention. There are a number of methods known in the art of attaching superabrasive particles to working surfaces of tools. One common approach involves depositing a metal layer onto an arrangement of superabrasive particles, securing the particles therein, where said layer may then be attached to or incorporated into the working surface of a tool. Another method is to apply a resin to the intended working surface, situate a plurality of superabrasive particles in the resin, then cure the resin to provide a means of securing the particles in place. The precursor tool of the present invention may be employed in conjunction with these and similar methods to make a tool with superabrasive particles that share a common orientation or set of orientations.

In a preferred embodiment, each oriented superabrasive crystal in a completed tool precursor is situated in solid binding material and oriented so that what will be its working end is facing the precursor substrate. The opposite end of each particle faces away from the substrate. Preferably, once particle orientation is complete the layer of binding material is rendered thin enough so that a substantial portion of this end of each particle is exposed. Still more preferably, the binding material covers about 20% to about 35% of the particle's height. This can be done by removing excess binding material either before or after curing if needed. For some binding materials, the process of curing may render the layer thinner due to the loss of water or volatiles.

Figure 2:
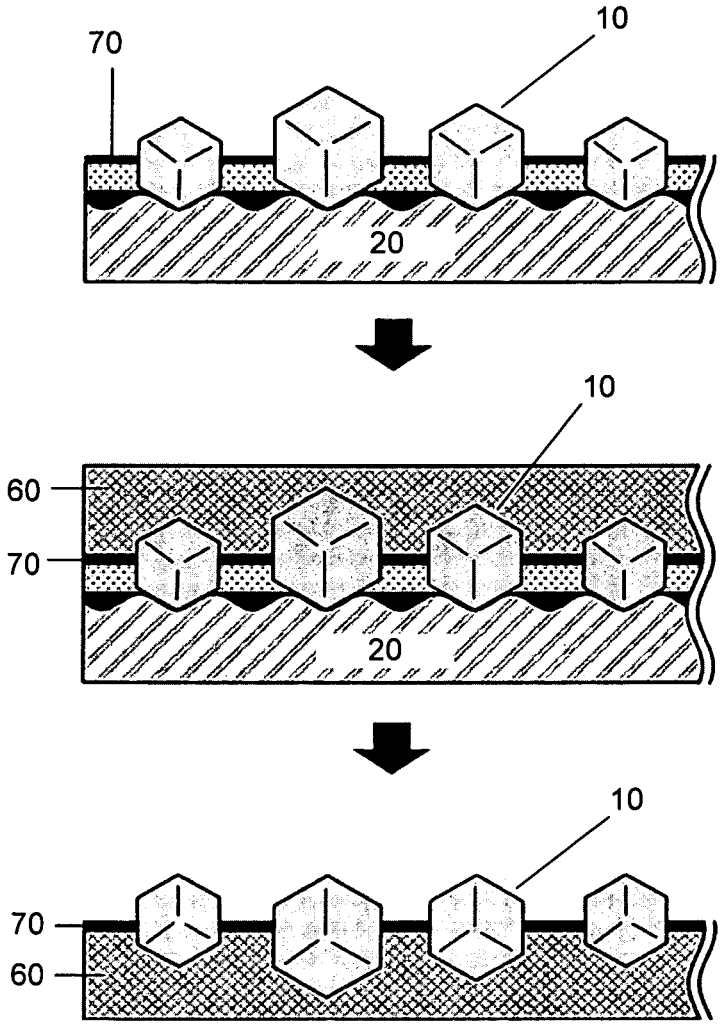
FIG. 2 shows the making of a superabrasive tool element from a side view in which superabrasive particles are embedded in a metal.

Once the binding material is cured, the tool precursor can serve as a template for situating the superabrasive particles in the working surface of a tool or a tool element. In one embodiment as illustrated in FIG. 2, the particles 10 are embedded in a metal 60 that can be bonded to a tool or otherwise incorporated into its working surface. In a specific embodiment this metal is nickel. In a more specific embodiment, nickel is plated onto the top surface of the binding layer and particles. However, in order to seat the superabrasive particles more securely, it may be desirable to interpose a metal binding layer 70 that more readily forms a chemical bond with the particles. For example, carbide formers can form such bonds with diamond or cubic boron nitride superabrasive particles. Therefore, in another specific embodiment, a layer of carbide-forming metal is deposited onto the particles and binding layer. Examples of carbide-forming metals that may be used are chromium, titanium, molybdenum, tungsten, cobalt, and tantalum. In a preferred embodiment, the carbide-forming metal is chromium. The carbide-forming metal may be deposited by methods known in the art, such as chemical vapor deposition. Nickel may then be plated onto the carbide-forming metal layer and the exposed particles. The binding layer may then be removed to expose the cutting surfaces of the particles.

Figure 3:
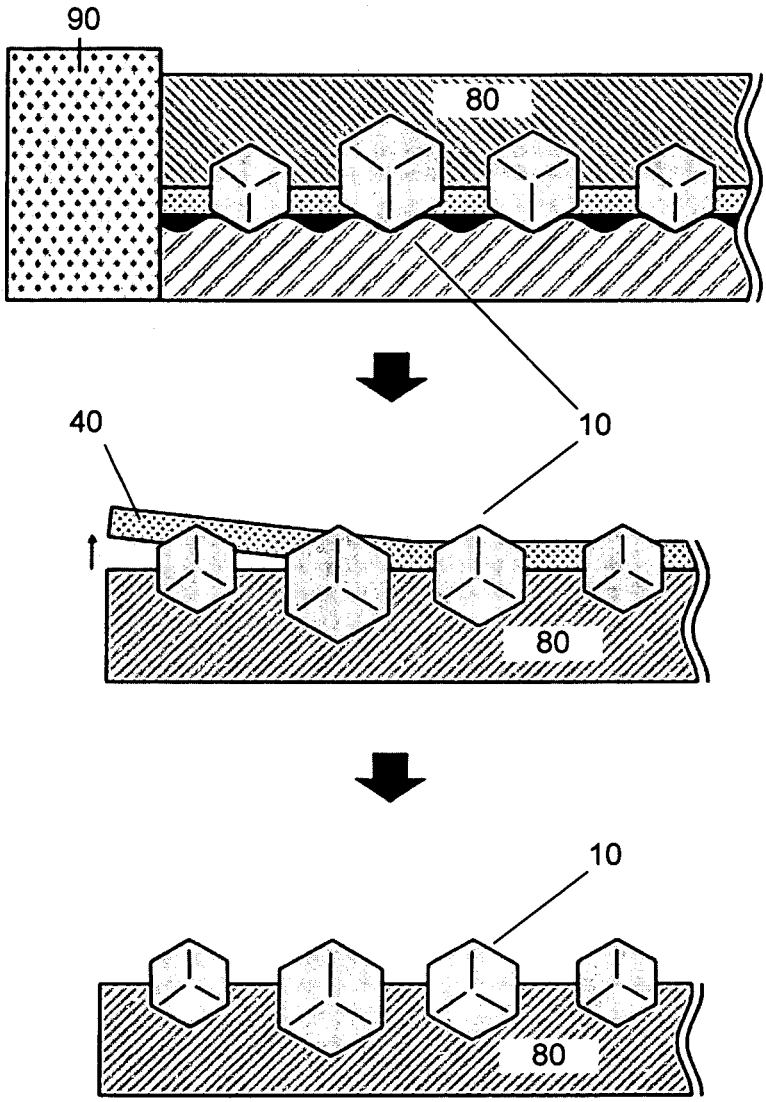
FIG. 3 shows the making of a superabrasive tool element from a side view in which superabrasive particles are embedded in a resin.

In an alternate embodiment shown in FIG. 3, the exposed ends of the superabrasive particles 10 are cast in a resin 80. Use of resins for retaining superabrasive particles for tool applications is set forth in detail in U.S. Pat. No. 7,258,708, which is incorporated herein by reference. The resin can be any resin which is curable to a degree of hardness that will retain the particles under working conditions. Some suitable resins include, but are not limited to, epoxy resins, polyimide resins, polycarbonate resins, formaldehyde resins, polyester resins, and polyurethane resins. The tool precursor may be placed in a mold 90 that will impart a shape to the piece that facilitates incorporation into the eventual tool. The resin material is then applied to the top surface of the binding material 30 and particles. Vacuum casting may be employed to minimize voids in the resin. Once the resin is cured, the binding agent can be peeled off to expose the working ends of the particles. Depending on the binding material and resin material used, it may be necessary to use a parting agent so that they may be separated after curing. In a preferred embodiment, before casting the top surface of the binding material and particles is sprayed with a parting agent.

Once the superabrasive particles are embedded into a material and the binding material is removed, the resulting tool or tool element exhibits a plurality of particles that share a substantially common orientation or set of orientations. In a particular aspect, where the particles were oriented allowed to rest against the substrate in the tool precursor, the particles in the resulting tool all protrude from the tool surface by substantially the same amount. For precursors utilizing a flat substrate, this method provides a tool with a substantially level cutting surface. However, it will be appreciated that substrates having other profiles may be used, so that the present method can provide a cutting surface with more complex contours, but where each superabrasive particle protrudes by the same amount. For example, a tool may be desired that has a cutting surface with a convex profile, where the center of the working surface extends farther toward the workpiece than does the periphery. This is particularly useful in compensating for the deformation that may occur in more flexible workpieces. CMP pads, for example, may flex under the pressure exerted by a superabrasive pad conditioner. A curved working surface allows more of the abrasive particles to maintain contact with the workpiece. To create such a tool, a precursor would be used that has a substrate with the opposite profile (i.e. concave). In accordance with the present invention, this precursor can be used to create a tool having a desired profile, while maintaining the particle height across the surface. Possible profiles included curved, wavy profiles, as well as profiles having polygonal bases, e.g. rhomboidal and pyramidal.

Figure 4:
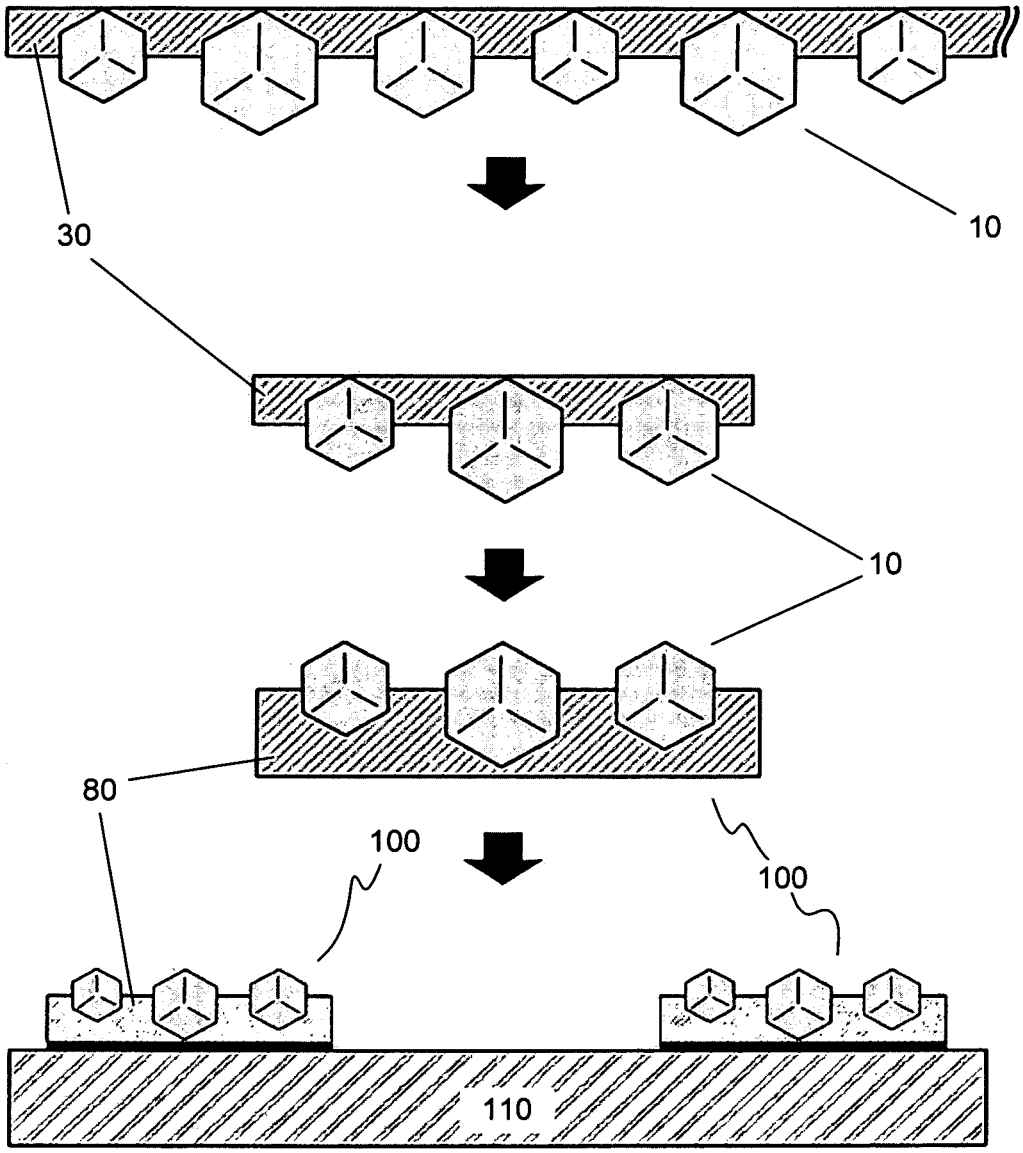
FIG. 4 shows the production of tool elements from a side view as shown in FIG. 3 and attachment thereof to a tool body.

The tool element formed by the above process may be made the working surface of a tool by being attached to the tool. The tool element may be made initially in a shape that corresponds to the desired working surface. Alternatively, the particles may be embedded in a larger sheet of material that may then be divided so as to form multiple tool elements. For example, the method of embedding oriented particles in resin may be used in the mass production of tool elements as shown in FIG. 4, where a large number of particles 10 are oriented in a sheet of binding material 30 and then embedded in resin 80. The resin is then cured and cut into individual tool elements 100. These elements may each be attached to separate tools or, as shown here, a plurality of elements may be attached to a single tool 110. This allows the making of a composite superabrasive tool with a plurality of superabrasive elements which may have either similar or different particle arrangements and orientation distributions.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A method of making a superabrasive tool precursor, comprising:

(a) placing a layer of a viscous medium on a surface of a substrate, said viscous medium having a density and a viscosity;

(b) distributing superabrasive particles on the layer of viscous medium; and (c) heating the viscous medium to decrease its viscosity, so that the superabrasive particles move at least partially through the viscous medium toward the substrate, during which the superabrasive particles are free to rotate, wherein the viscosity is selected to affect the percentage of superabrasive particles exhibiting the same orientation; and a percentage of from 65% to about 85% of the superabrasive particles exhibit substantially the same orientation when they come to rest.

2. The method of claim 1, wherein the superabrasive particles are diamond particles.

3. The method of claim 1, wherein the viscous medium has a lower density than that of the superabrasive particles.

4. The method of claim 1, wherein the movement of the superabrasive particles is due at least in part to a force selected from the group consisting of: gravitational, centripetal, magnetic, electromagnetic, and combinations thereof.

5. The method of claim 4, wherein the force is gravitational.

6. The method of claim 4, wherein the force is centripetal.

7. The method of claim 6, wherein a magnitude of centripetal force is selected to affect the percentage of superabrasive particles exhibiting the same orientation.

8. The method of claim 1, wherein the superabrasive particles come to rest in physical contact with the substrate.

9. The method of claim 1, wherein the percentage of the superabrasive particles are oriented with an apex toward the substrate.

10. The method of claim 1, wherein the percentage of the superabrasive particles are oriented with an edge toward the substrate.

11. The method of claim 1, wherein the viscous medium contains a wetting agent.

12. The method of claim 1, wherein the layer of viscous medium has a depth sufficient to allow the superabrasive particles to rotate at least 180° before contacting the substrate.

* * * * *